US006491249B2

(12) United States Patent
Park

(10) Patent No.: US 6,491,249 B2
(45) Date of Patent: Dec. 10, 2002

(54) DEVICE FOR WINDING POWER CORD OF UP-RIGHT VACUUM CLEANER

(75) Inventor: Joung-soo Park, Cheonrabukdo (KR)

(73) Assignee: Samsung Kwangiu Electronics Co. Ltd. (KR)

( * ) Notice: Subject to any disclaimer, the term of this patent is extended or adjusted under 35 U.S.C. 154(b) by 16 days.

(21) Appl. No.: 09/760,895

(22) Filed: Jan. 17, 2001

(65) Prior Publication Data

US 2001/0028014 A1 Oct. 11, 2001

(30) Foreign Application Priority Data

Jan. 17, 2000 (KR) ..... 00-2058

(51) Int. Cl.[7] ..... B65H 75/34; B65H 75/36
(52) U.S. Cl. ..... 242/386; 247/400
(58) Field of Search ..... 242/386, 400, 242/128

(56) References Cited

U.S. PATENT DOCUMENTS

| | | | | | |
|---|---|---|---|---|---|
| 1,714,225 | A | * | 5/1929 | Hyde et al. | 242/400 |
| 1,897,087 | A | * | 2/1933 | Tamarin | 242/386 |
| 1,921,439 | A | * | 8/1933 | Tamarin | 242/400 |
| 1,936,463 | A | * | 11/1933 | Strang | 242/400 |
| 2,037,668 | A | * | 4/1936 | Smith et al. | 242/386 |
| 2,418,130 | A | * | 4/1947 | Lofgren | 242/386 |
| 2,757,404 | A | * | 8/1956 | Kelly | 242/387 |
| 2,946,071 | A | * | 7/1960 | Nilsson | 242/400 |
| 2,949,251 | A | * | 8/1960 | Sparklin | 242/386 |
| 3,021,088 | A | * | 2/1962 | Bennett | 242/400 |
| 3,498,563 | A | * | 3/1970 | Palmieri | 242/386 |
| 4,062,430 | A | * | 12/1977 | Momberg | 191/12 R |
| 4,658,465 | A | * | 4/1987 | Keane et al. | 15/323 |
| 4,720,890 | A | * | 1/1988 | Jacob | 15/323 |
| 4,912,593 | A | * | 3/1990 | Iwao et al. | 360/212 |
| 5,023,410 | A | * | 6/1991 | Danielson et al. | 191/12.2 |
| 5,058,819 | A | * | 10/1991 | Lacour | 242/54 R |
| 5,135,181 | A | * | 8/1992 | Wesselink | 242/107 |
| 5,230,480 | A | * | 7/1993 | Perry | 242/85.1 |

FOREIGN PATENT DOCUMENTS

| | | | | |
|---|---|---|---|---|
| JP | 60/188277 | * | 9/1985 | B65H/75/48 |
| JP | 4-189330 | * | 7/1992 | A47L/9/26 |
| JP | 8/126594 | * | 5/1996 | A47L/5/28 |
| WO | WO 01/73911 A1 | * | 10/2001 | H02G/11/02 |

* cited by examiner

*Primary Examiner*—Donald P. Walsh
*Assistant Examiner*—Daniel K Schlak
(74) *Attorney, Agent, or Firm*—Burns, Doane, Swecker & Mathis, L.L.P.

(57) ABSTRACT

A device for winding a power cord of an up-right vacuum is disclosed to wind the power cord on a fixed cord hanger and a rotary cord hanger by the rotation of the winding device for an easy winding. The device for winding the power cord includes a rotary member 100 inserted from the front side of the main body 200 into the rear side thereof. A power cord holder 400 is coupled from the rear side of the main body 200 into the front side for winding with guiding the power cord 300 toward a circumference direction by a rotation of the rotary member 100. A rotary hanger 500 is engaged on an upper part within a radius of the power cord holder 400 for pivoting together to smoothly wind the power cord 300 in a case of passing the power cord holder 400 and for repatriating not to come out the wound power cord 300 after passing the cord holder. And a fixed cord hanger 600 is positioned on a lower part inside the radius of the power cord holder 400 for winding the power cord 300 while passing the power cord holder 400. Therefore, the device for winding is excellent in sanitation without directly touching the power cord by hands.

3 Claims, 6 Drawing Sheets

FIG. 6
RELATED ART
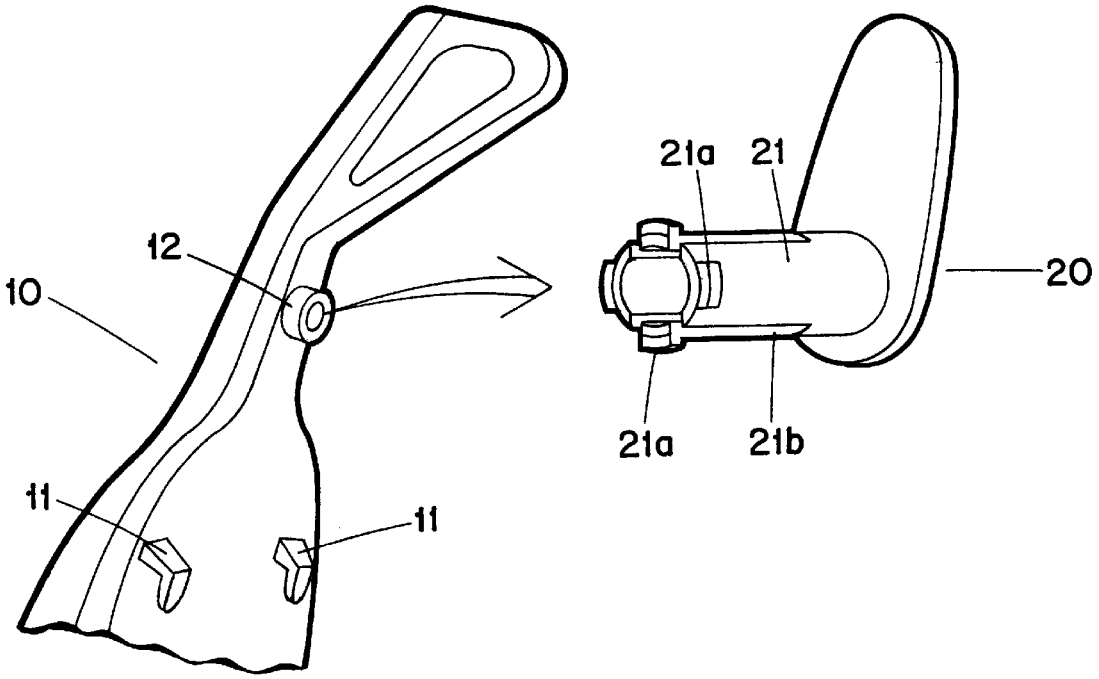
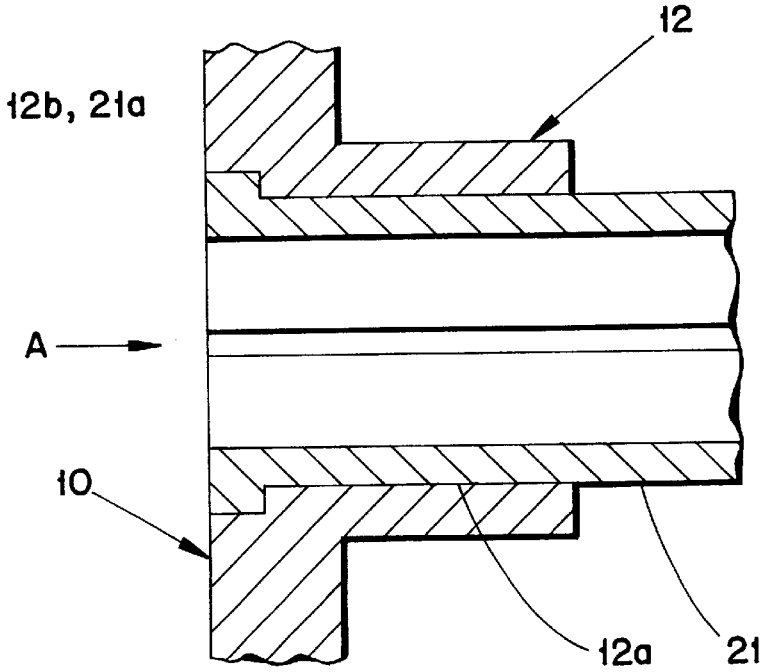
FIG. 7
RELATED ART

DEVICE FOR WINDING POWER CORD OF UP-RIGHT VACUUM CLEANER

This application claims priority under 35 U.S.C. §§ 119 and/or 365 to 002058/2000 filed in Republic of Korea on Jan. 17, 2000; the entire content of which is hereby incorporated by reference.

BACKGROUND OF THE INVENTION

1. Field of the Invention

The present invention relates to a device for winding a power cord of an upright vacuum cleaner, and more particularly to a device for winding the power cord, which is excellent in sanitation without directly touching the power cord by hands.

2. Description of the Related Art

An up-right vacuum cleaner generally sucks alien substances on a floor through a sucking hose and a sucking inlet.

The up-right vacuum cleaner is designed to clean at a point far from an electric outlet by a power cord. As shown in FIG. 5 through FIG. 8, a conventional power cord 30 is wound and stored into a rotary cord hanger 20 engaged on the point of forming a triangle shape with a couple of fixed cord hanger 11 equipped in a rear central lower part of a main body 10.

The fixed cord hanger 11 is unified as a ]-shape on the rear side of the main body 10. The rotary cord hanger 20 is roughly formed as a ]-shape and inserted into a hole 12*a* formed on an inserting section 12 of the main body 10, while the rotary cord hanger 20 includes a slot 21*b* slotted at an angle of 90 degrees the inserting section 21 having a hook 21*a* for safely reaching to a hanging-sill 12*b* arranged and formed at the angle of 90 degrees within the inside of the wall.

Accordingly, the rotary cord hanger 20 is released downward by rotating the angle of 180 degrees to use the power cord 30 in the state of FIG. 5 and then plugged in the electric outlet for freely moving within the length of the power cord 30.

At this time, the hook 21*a* is rotated at every 90-degree angle and safely reached by the hanging-sill 12*b* if the rotary cord hanger 20 is pivoted to left or right direction in the case of a rotation.

Then the power cord 30 is gripped to hang on the fixed cord hanger 11 and the rotary cord hanger 20 and fastened to the fixed cord hanger 11 and the rotary cord hanger 20 with rotating as like in FIG. 5.

However, winding the power cord 30 by the fixed cord hanger 11 and the rotary cord hanger 20 is obviously less satisfactory in sanitation because of staining alien substances on the floor.

It is still less satisfactory to complicate the winding operation because of directly winding the power cord 30 by hands.

SUMMARY OF THE INVENTION

It is, therefore, an object of the present invention to solve the problems involved in the related art and provide a device for winding a power cord of an up-right vacuum cleaner on a fixed cord hanger and a rotary cord hanger by the rotation of a winding device engaged on a main body without a direct hand-gripping.

To achieve the above objects, a device for winding the power cord of an up-right vacuum cleaner according to the present invention, is provided to wind the power cord on a rear side of a main body. A rotary member is inserted from the front side of the main body into the rear side thereof. A power cord holder is coupled from the rear side of the main body into the front side to wind with guiding the power cord toward a circumference direction by the rotation of the rotary member. A rotary hanger is engaged on the upper part of the main body within a radius of the power cord holder for pivoting to allow winding of the power cord when the power cord holder rotates past the rotary hanger, and then repatriating to prevent the power cord from becoming unwound after a passing of the rotary hanger by the power cord holder. A fixed cord hanger is positioned on the lower part inside of the radius of the power cord holder for winding the power cord while passing the power cord holder.

Thereby, the device for winding the power cord is provided for an excellent sanitation and for the easy winding.

BRIEF DESCRIPTION OF THE DRAWINGS

The above and other objects, features and advantages of the present invention will become more apparent from the following detailed description when taken in conjunction with the accompanying drawings in which:

FIG. 6 is a dissembled perspective view showing a dissembled state of a rotary cord hanger in FIG. 5;

FIG. 7 is a cross-sectional view showing an installed state of a rotary cord hanger in a main body in FIG. 6.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
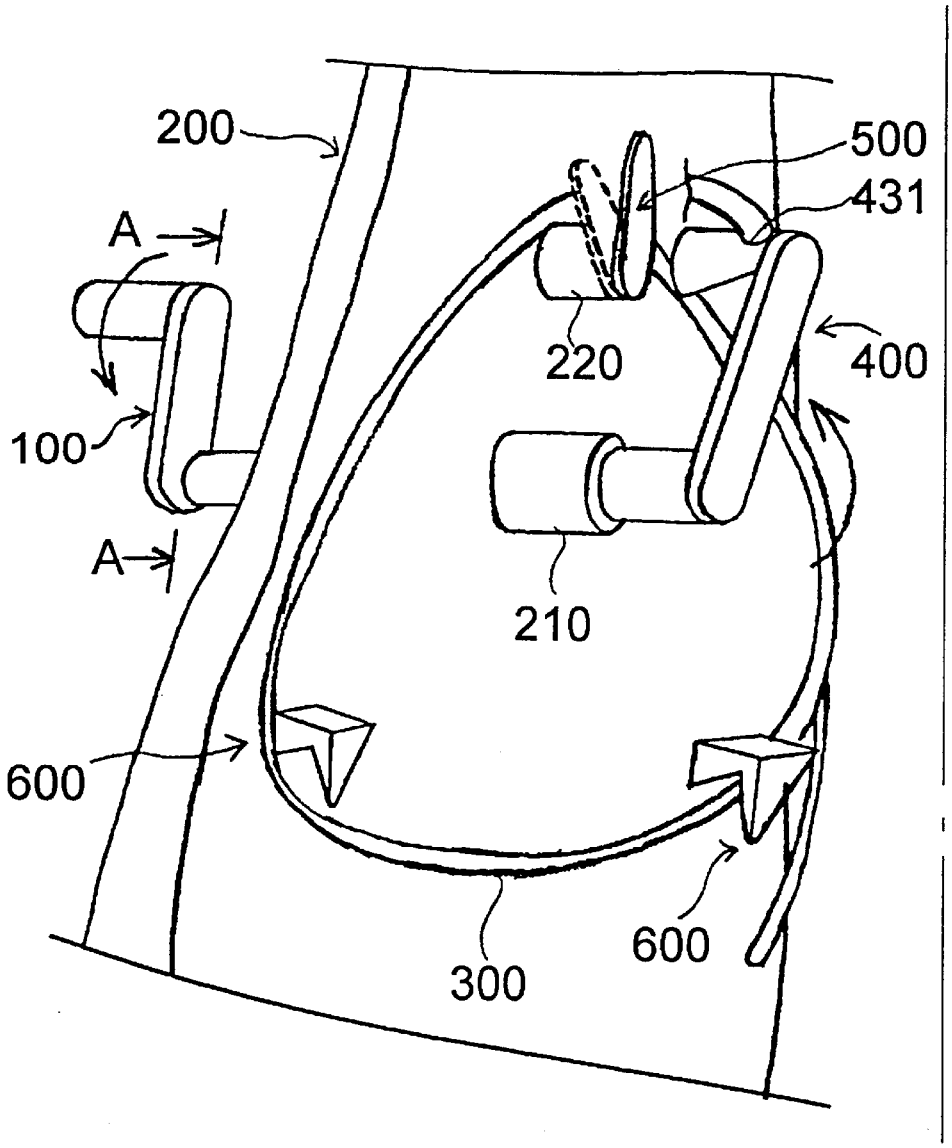
FIG. 1 is a perspective view showing an installed state of a device for winding the power cord in a main body of an up-right vacuum cleaner according to the present invention.
Figure 2:
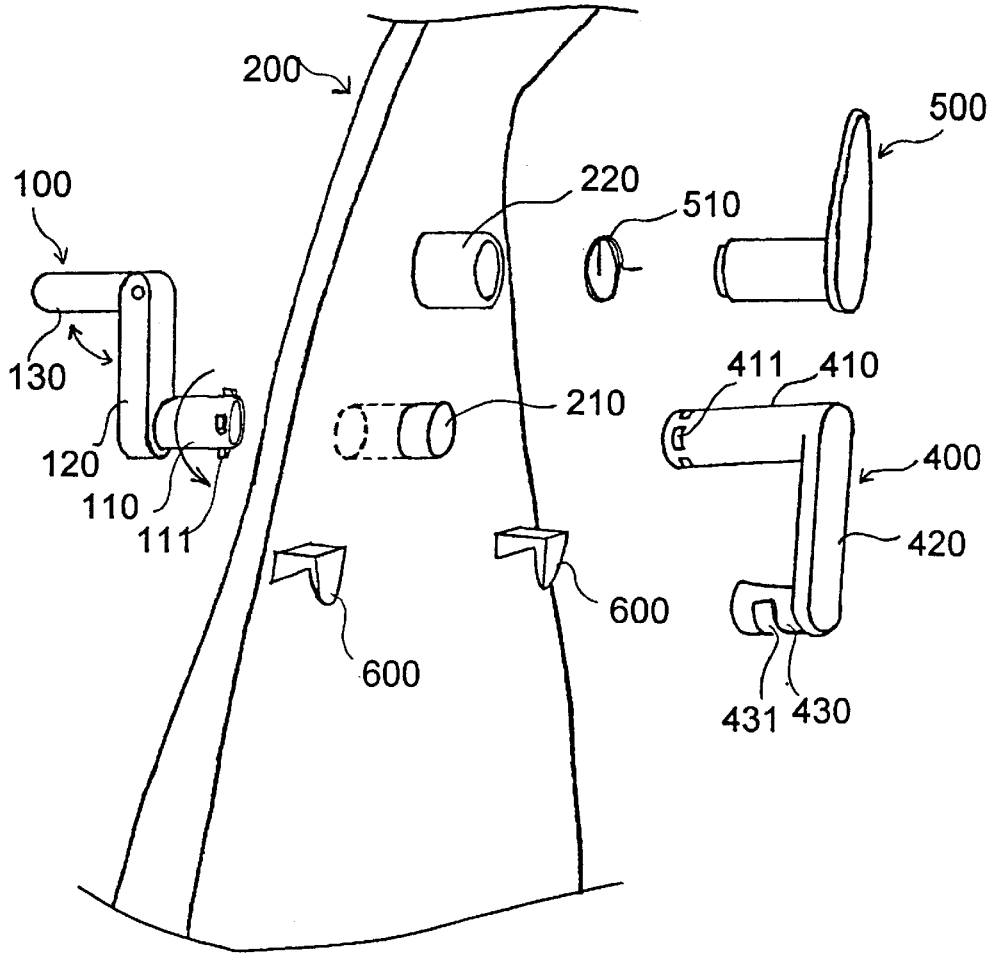
FIG. 2 is a dissembled perspective view showing an installed state of a device for winding the power cord of an up-right vacuum cleaner according to the present invention.
Figure 3:
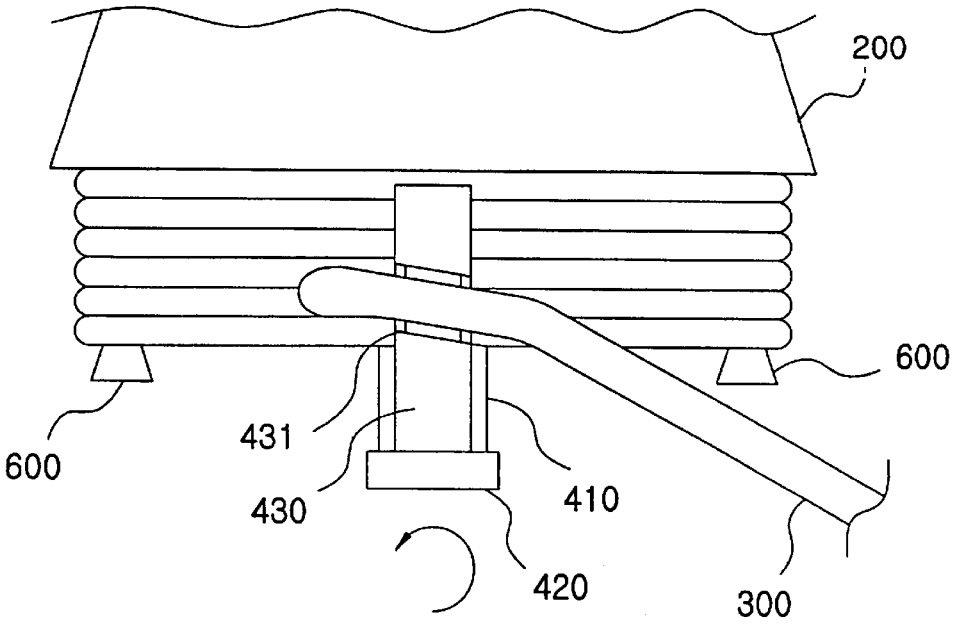
FIG. 3 is a partial top-plan view showing a positioned state of a power cord holder included to a device for winding the power cord on an upper part.
Figure 4:
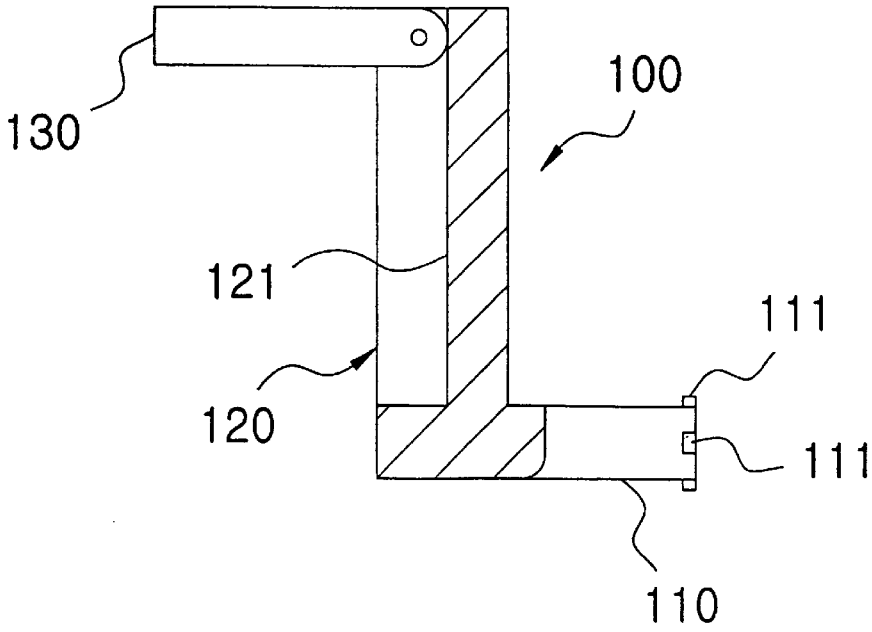
FIG. 4 is a cross-sectional view cut by an A—A line shown in FIG. 2.
Figure 5:
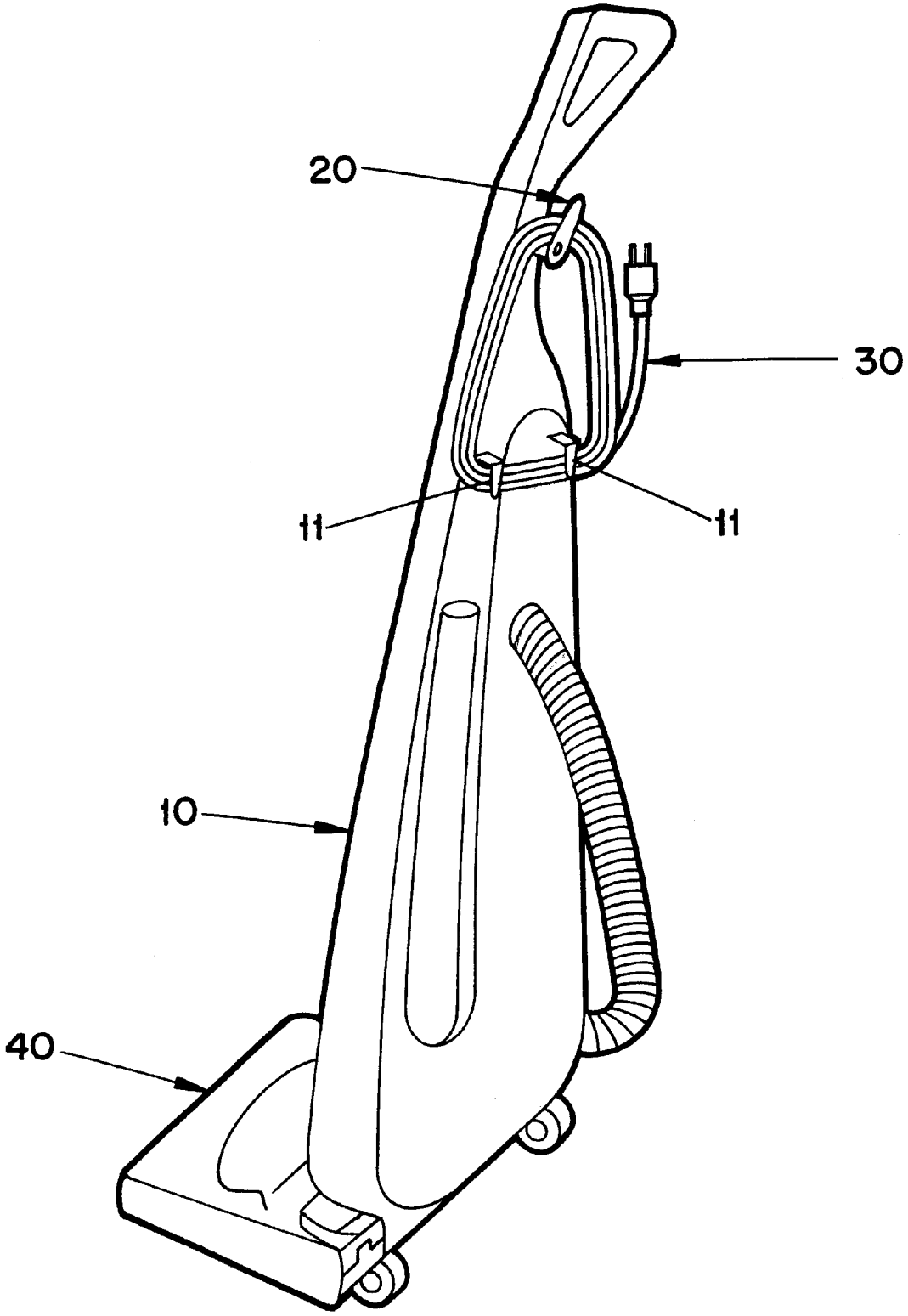
FIG. 5 RELATED ART
FIG. 5 is a perspective view showing an up-right vacuum cleaner according to a conventional technology.
Figure 8:
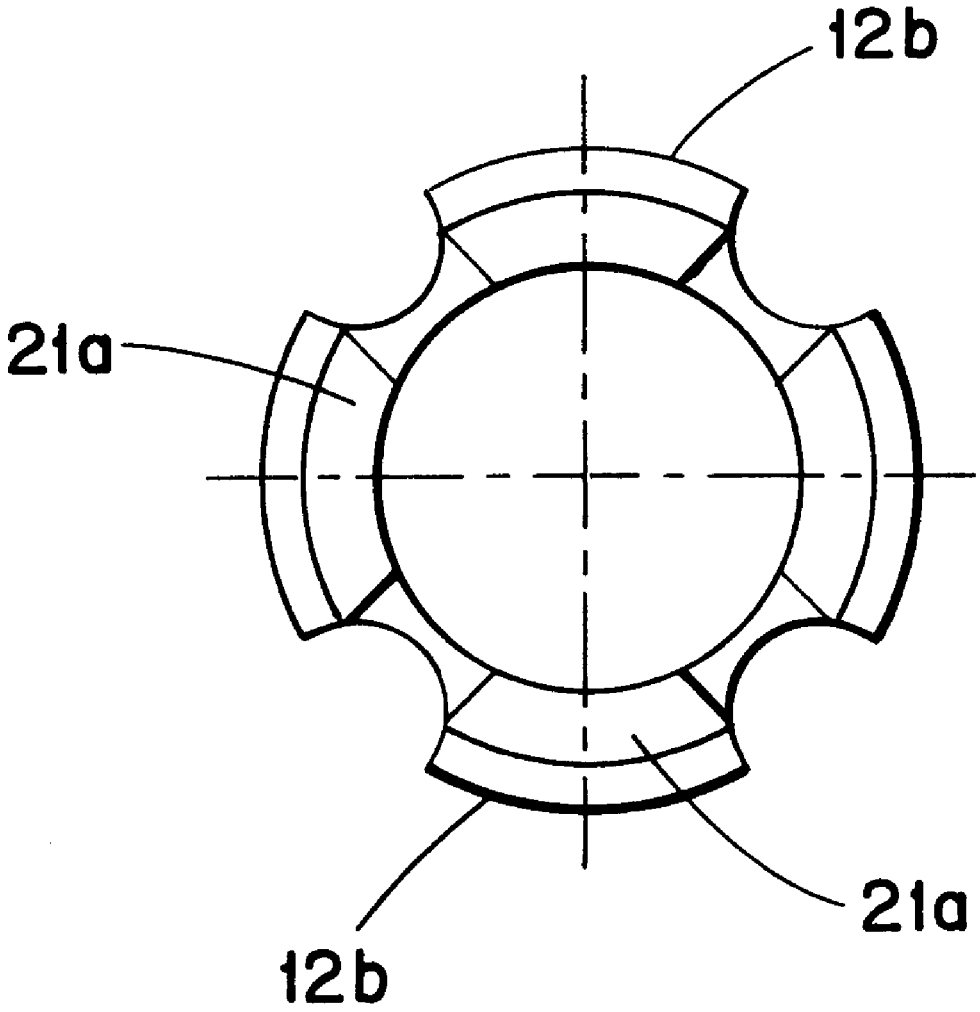
FIG. 8 RELATED ART
FIG. 8 is a lateral-side view of an A direction in FIG. 7.

FIG. 1 is a perspective view showing an installed state of the device for winding the power cord in a main body of the up-right vacuum cleaner according to the present invention. FIG. 2 is a dissembled perspective view showing an installed state of the device for winding the power cord of the up-right vacuum cleaner according to the present invention. FIG. 3 is a partial top-plan view showing a positioned state of the power cord holder included to the device for winding the power cord on the upper part. FIG. 4 is a cross-sectional view cut by an A—A line shown in FIG. 2.

Referring to FIG. 1, the device for winding the power cord of the up-right vacuum cleaner according to the present invention includes a rotary member 100 inserted and coupled from the front side into the rear side of the main body 200. A power cord holder 400 is coupled from the rear side of the main body 200 into the front side to wind with guiding the power cord 300 toward a circumference direction by the rotation of the rotary member 100. A rotary hanger 500 is engaged to the upper part of the main body 200 within a radius of the power cord holder 400 for pivoting when the power cord holder 400 rotates past the rotary hanger 500 to allow the winding of the power cord 300, and then repatriating to prevent the power cord 300 from becoming unwound after a passing of the rotary hanger 500 by the power cord holder 400. A fixed cord hanger 600 is positioned on the lower part inside of the radius of the power cord holder 400 for winding the power cord 300 while passing the power cord holder 400.

Now, the rotary member 100 includes a connecting section 110 inserted from the front side of the main body 200 into the rear side thereof; an extending section 120 elongated as a unity at an angle of 90 degrees with the connecting section 110; and a handle section 130 engaged at the angle of 90 degrees in an opposite direction of the connecting section 110 by extending from the extending section 120.

A hook 111 on a front end of the connecting section 110 is projected as a constant width and length toward the circumference direction and equipped at a predetermined angle.

The handle section 130 is pivotally engaged to the front side of the extending section 120 and subsided into a groove 121 formed on the extending section 120.

And the power cord holder 400 includes an extension coupling section 410 having an empty inside and forming a hook coupling groove 411 inserted the hook 111 on the circumference for coupling with the connecting section 110 having the hook 111 inserted into a holder inserting section 210 formed on the rear side of the main body 200; an extending section 420 extended to a constant length while making the angle of 90 degrees with the other end of the extension coupling section 410; and a cord fastening section 430, having a power cord fastening groove 431, elongated and projected toward the extension coupling section 410 from the extending section 420 for fastening the power cord 300 to the circumference direction.

Here, an opening position of a slant angle of the power cord-fastening groove 431 is determined by the position of the power cord 300 inserted into the main body 200.

That is, when an inserted point of the power cord 300 is in the rear right side of the main body 200 or in the rear left side thereof, the slant angle is opened toward the right side or left side respectively as shown in FIG. 3.

The rotary hanger 500 is engaged by a repatriating member 510 like a twisting spring. An end of the rotary hanger 500 is fastened to a rotary hanger containing section 220 projected to the rear side of the main body 200 and the other end thereof is fastened to the rotary hanger 500. After the rotary hanger 500 is installed in the rotary hanger containing section 220, it is not only come out but also pivoted and repatriated toward an adding direction of the rotating pressure. Thus, the rotary hanger 500 prevents a slip of the power cord 300.

Accordingly, the connecting section 110 of the rotary member 100 is first inserted from the front side of the main body 200 to mount the device for winding the power cord according to an embodiment of the present invention. And the power cord holder 400 is inserted to a holder inserting section 210 of the main body 200. Then an extension connecting section 410 of the power cord holder 400 is coupled to the connecting section 110 of the rotary member 100.

That is, the hook 111 of the connecting section 110 is coupled to the hook-coupling groove 411 of the extension coupling section 410 in the main body 200.

Then, an assembling will be finished with that an end of the repatriating member 510 is fixed to the rotary hanger 500 and the other end of the repatriating member 510 is coupled to the rotary hanger containing section 220.

Consequently, the power cord 300 is positioned on the power supply-fastening groove 431 formed in the cord fastening section 430 of the power cord holder 400. When the rotary member 100 is rotated to the winding direction, the power cord 300 guided by the power supply fastening groove 431 is wound on the rotary hanger 500 and the fixed cord hanger 600.

As further detail explanation, when the handle section 130 of the rotary member 100 is gripped and rotated, the cord fastening section 430 of the power cord holder 400 connected to the connecting section 110 is fastened and rotated. And the rotary hanger 500 is rotated to a direction against the elasticity of the repatriating member 510 and pivoted with the cord fastening section 430 together if the cord fastening section 430 fastening the power cord 300 passes by the upper part of the rotary hanger 500.

Then, the rotary hanger 500 is repatriated by the repatriating member 510 and prevents the slip of the power cord 300 when the cord fastening section 430 passes.

Meanwhile, when the rotary member 100 is not used, rotating and containing the handle section 130 to the groove 121 of the extending section 120 prevent the hanging by an action of projecting the rotary member 100.

Accordingly, the power cord 300 is wound by the cord fastening section 430 with rotating the rotary member 100, thus avoiding the necessity to directly wind the power cord 300 by hand, as well as avoiding hand contact with alien substances on the cord.

According to the present invention as described above, a power cord is wound on a fixed cord hanger and a rotary cord hanger by the rotation of a winding device engaged on a main body without a direct hand-gripping. Thus, the device for winding the power cord of the up-right vacuum cleaner is provided for an excellent sanitation and for the easy winding.

While the present invention has been described herein with reference to particular embodiments thereof, a latitude of modification, various changes and substitutions are intended in the foregoing disclosure. And in some instances, some features of the invention will be employed without a corresponding use of other features without departing from the spirit of the invention as set forth herein.

What is claimed is:

1. A device for winding the power cord of an up-right vacuum cleaner, which winds a power cord on one of first and second sides of a main body, the device comprises:

a rotary member inserted and coupled between the first side and the second side of the main body;

a power cord holder coupled to the rotary member at the second side of the main body for winding with guiding the power cord toward a circumference direction by a rotation of the rotary member;

a rotary hanger engaged on an upper part of the main body within a radius of the power cord holder for pivoting to allow winding of the power cord when the power cord holder rotates past the rotary hanger and for repatriating to prevent the power cord from becoming unwound after a passing of the rotary hanger by the power cord holder; and a fixed cord hanger positioned on a lower part of the main body inside the radius of the power cord holder for winding the power cord while the power cord holder passes the fixed cord hanger.

2. The device of claim 1, wherein the rotary member comprises:

a connecting section inserted between the first side of the main body and the second side thereof;

an extending section elongated as a unity at a predetermined angle with the connecting section; and a handle section elongated and engaged at a predetermined angle in an opposite direction of the connecting section and pivotally engaged on the first side of the connecting section for fitting into a groove formed in the extending section.

3. The device of claim 2, wherein the power cord holder comprises:

an extension coupling section having one end thereof inserted into a holder inserting section formed on the second side of the main body and coupled to the connecting section;

an extending section having a constant length while making a predetermined angle with another end of the extension coupling section; and a cord fastening section elongated and projected toward the extension coupling section from the extending section for opening a slant angle to a position of the power cord inserting a power cord-fastening groove to fasten the power cord toward a circumference direction into the main body.

* * * * *